US005448040A

United States Patent [19]

Deplano et al.

[11] Patent Number: 5,448,040

[45] Date of Patent: Sep. 5, 1995

[54] ROLLER FOR FURNACES, PARTICULARLY FOR IRON AND STEEL MAKING FURNACES FOR HEATING SLABS OR THE LIKE

[75] Inventors: Stefano Deplano; Roberto Millone, both of Genova; Maurizio Patrone, Campomorone, all of Italy

[73] Assignee: Italimpianti S.p.A., Italy

[21] Appl. No.: 276,614

[22] Filed: Jul. 18, 1994

[30] Foreign Application Priority Data

Jul. 23, 1993 [IT] Italy ..... GE93A066

[51] Int. Cl.[6] ..... H05B 6/22

[52] U.S. Cl. ..... 219/647; 219/653; 373/42; 432/236

[58] Field of Search ..... 373/75, 76, 113, 116, 373/42, 109, 115; 219/602, 615, 618, 619, 628–632, 645, 647, 653, 388; 29/895.32; 432/236, 246

[56] References Cited

U.S. PATENT DOCUMENTS

| | | | |
|---|---|---|---|
| 1,968,675 | 7/1934 | Fahrenwald | 432/246 |
| 3,058,731 | 10/1962 | Bloom | 165/90 |
| 3,103,346 | 9/1963 | Buckholdt et al. | 432/236 |
| 3,965,974 | 6/1976 | Sernetz et al. | 432/246 |
| 4,553,931 | 11/1985 | Wachi et al. | 432/246 |
| 4,934,514 | 6/1990 | Flaugher et al. | 198/780 |
| 4,991,276 | 2/1991 | Bricmont | 29/124 |

FOREIGN PATENT DOCUMENTS 512892 2/1921 France .

*Primary Examiner*—Bruce A. Reynolds
*Assistant Examiner*—Tu Hoang
*Attorney, Agent, or Firm*—Larson and Taylor

[57] ABSTRACT

A roller for furnaces, is used with a plurality of rollers substantially parallel to each other. The roller is provided with a plurality of annular collars which are side by side and spaced apart. The annular collars are cooled by means of a flow of cooling fluid which is oriented transversely with respect to their axis and parallel to their median plane. The annular riders are made in tubular form and may be of toroidal form and are connected separately each to the supply duct and to the return duct for the cooling fluid. They may also be formed by the individual turns of a tubular spiral or by a number of successive segments of a spiral which are connected via their ends to the supply duct and to the return duct.

22 Claims, 6 Drawing Sheets

ROLLER FOR FURNACES, PARTICULARLY FOR IRON AND STEEL MAKING FURNACES FOR HEATING SLABS OR THE LIKE

FIELD OF THE INVENTION

The invention relates to a roller for furnaces, particularly for iron and steel making furnaces for heating slabs, or the like, this roller being part of a sole consisting of a plurality of rollers substantially parallel to each other, and being provided with a plurality of annular collars (annular riders) which are side by side and spaced apart, the rollers and the annular collars being cooled with a cooling fluid.

BACKGROUND OF THE INVENTION

In known rollers of this type, the annular riders are cooled by means of a flow of cooling fluid, for example cooling water, which is orientated parallel to the axis of the said annular collars and transversely with respect to their median plane.

The cooling of the annular riders is necessary to prevent scoria from adhering to them. This cooling is therefore essential and has to be very effective.

SUMMARY OF THE INVENTION

The invention therefore addresses the problem of improving a roller of the type described initially, in such a way that, as a result of simple and relatively economical construction, it is possible to achieve an extremely effective cooling action on the annular riders.

The invention resolves the above problem with a roller of the type described initially, in which the tubular collars (tubular riders) are cooled with a flow of cooling fluid orientated transversely with respect to the axis of the roller and parallel to the median plane of the collars.

The annular riders may be made and connected to the cooling fluid circulation system in various ways.

In one embodiment of the invention, the tubular riders are made in annular form, closed on themselves to form a toroid, and have a toroidal chamber with any cross-section.

In a first version of this embodiment, the toroidal chamber of each annular tubular rider is divided by a transverse partition, and an inlet which is connected to the supply duct of the cooling system and an outlet which is connected to the return duct of the cooling system are provided on opposite sides of the said partition. The roller, on which the annular riders are fixed may be made in such a way that it has two coaxial chambers, one for the supply of the cooling fluid and the other for the return of the cooling fluid, the inlet and outlet of each annular tubular rider being connected, by means of radial couplings, to the coaxial supply chamber and to the coaxial return chamber of the roller respectively. At one end of the roller, the coaxial chambers are connected to the supply duct and to the return duct respectively of a cooling system, while at the opposite end of the roller they are closed and may communicate with each other.

In a second version of the above embodiment of the invention, at least some annular tubular riders of the roller are connected in series with each other and to the cooling system, for example by means of connecting tubes extending substantially parallel to the axis of the roller, one of the terminal riders of the series being connected to the supply duct and the other to the return duct of the cooling fluid.

In both the embodiments described above, the annular tubular riders may be fixed so that they are joined directly to the outer peripheral surface of the roller. Alternatively, the annular riders may be fixed to the roller in a coaxial position and spaced from the peripheral surface of the roller by means of a plurality of spacers which compensate for the thermal expansion and contraction, and which are distributed at equal angular intervals over the outer peripheral surface of the roller.

In a variant embodiment, in place of the annular collars, the riders may consist of a tubular helicoid which extends over the whole of the part of the roller intended to support the iron or steel products, or may consist of a number of successive segments of tubular helicoid, each of which extends over only part of the axial length of the said part of the roller. The tubular helicoid, or each segment of tubular helicoid, may be connected in each case at one end to the supply duct and at the other end to the return duct of the cooling fluid, preferably at one end to the coaxial supply chamber of the roller and at the other end to the coaxial return chamber of the roller. In the case of a number of segments of tubular helicoid, distributed over the length of the roller, at least some of these may be connected in series with each other to the cooling fluid supply duct and return duct.

In order to prevent or reduce transverse movements of the iron or steel products with respect to their direction of transport, in other words parallel to the axis of the roller, when they are transported on rollers with helicoidal tubular riders, according to a further improvement of the invention, the tubular helicoid provided around a roller preferably has at least two sections with opposite inclinations, namely one right-handed section and one left-handed, or at least two segments of tubular helicoid provided around a roller are made with opposite inclinations, one right-handed and the other left-handed.

Naturally, the tubular helicoids of the various embodiments described above may also either be joined to the surfaces of the corresponding rollers or be spaced apart from them.

The characteristics of the invention described above, and in particular the making of the riders in the form of annular tubular elements or of tubular helicoids, enable larger cooling flows to be obtained, thus providing a more effective cooling action. The making of the riders in helicoidal form enables the point of support of the iron or steel product on the rollers to be varied continuously.

An additional object of the invention comprises other characteristics which further improve the roller for furnaces as described above and which form the subject of the subsidiary claims.

BRIEF DESCRIPTION OF THE DRAWINGS

The particular characteristics of the invention and the advantages derived therefrom will be more clearly understood from the description of some preferred embodiments, illustrated by way of example and without restriction in the attached drawings, in which.

DESCRIPTION OF THE PREFERRED EMBODIMENTS

Figure 1:
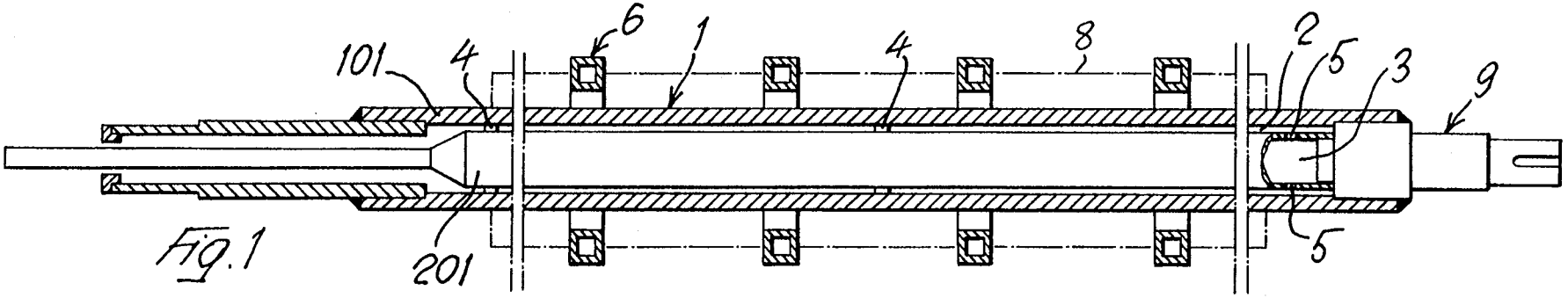
FIG. 1 shows an axial section through a first embodiment of the roller with annular riders according to the invention.

With reference to FIG. 1, a roller 1 for use in a furnace with a plurality of rollers substantially parallel to each other and spaced apart. The roller 1, particularly for an iron and steel making furnace for heating slabs, consists of two coaxial tubular cylindrical elements 101, 201, which are spaced apart by spacers 4, forming two coaxial chambers 2, 3. At one end of the roller 1, the chamber 3 formed by the inner space of the inner tubular element 201 is connected to the supply duct of the cooling system, particularly that of the cooling water, while the outermost chamber 2, formed by the cylindrical space between the inner tubular element 201 and the outer element 101, is connected to the return duct of the cooling system. The connections are made, for example, by means of sealed rotary joints. At the opposite end of the roller 1, the two chambers 2 and 3 are closed and are connected together by means of through holes 5 made in the wall of the inner tubular element 201. This makes it possible to create a circulation of the cooling fluid in the end area of the roller 1 opposite the end where connection is made to the cooling system. At one end at least, preferably at the end where the chambers 2 and 3 are closed, the roller 1 has a termination 9 for rotary coupling to driving means, which are not illustrated.

A number of annular tubular collars 6, forming what are known as riders, are provided outside the roller 1 and preferably distributed uniformly along it. The annular tubular riders 6 are closed on themselves to form tubular toroids. They have internal diameters greater than the external diameter of the roller 1, in other words that of the outer tubular element 101, and are fixed coaxially to the roller by means of spacers and compensators 7 which compensate for the effect of thermal expansion and contraction. The spacers and compensators 7 consist, for example, of U-shaped brackets placed between the outer peripheral surface of the roller 1 and the inner surface of the annular riders 6, to which they are connected with one of the opposite sides 107 in each case. The annular riders 6 have a rectangular or square cross section. Preferably the spacers and compensators 7 are fixed to the corresponding walls of the annular rider 6 and of the roller 1, with the free ends of the corresponding sides of the U profile. In particular, the spacers and compensators 7 have an extension in the axial direction with respect to the roller 1 corresponding to that of the annular collar 6.

Figure 5:
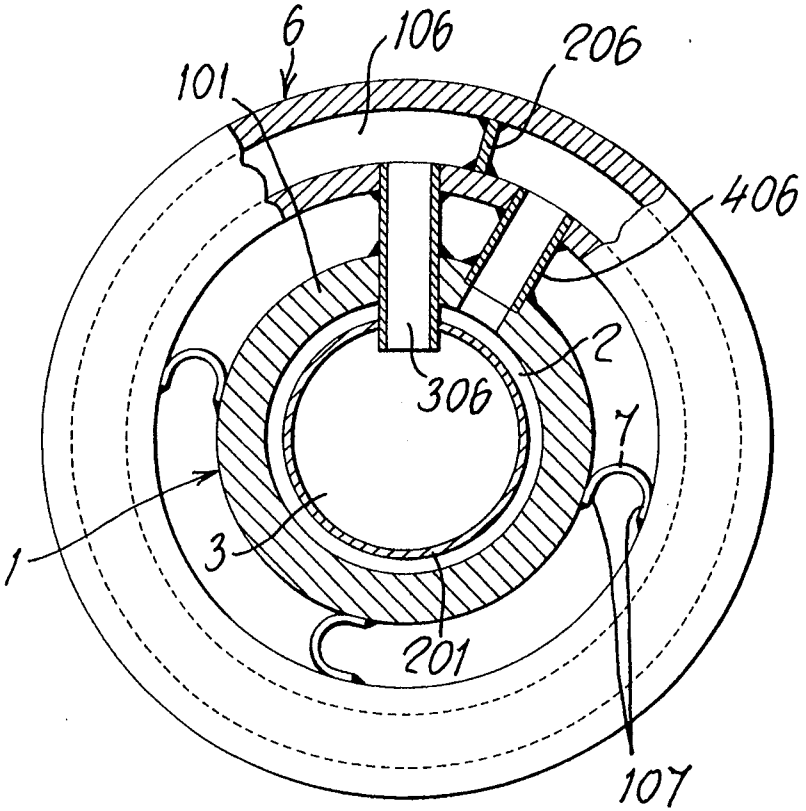
FIG. 5 is an enlarged cross section through the roller according to FIG. 1, with the annular tubular rider partially in section.
Figure 4:
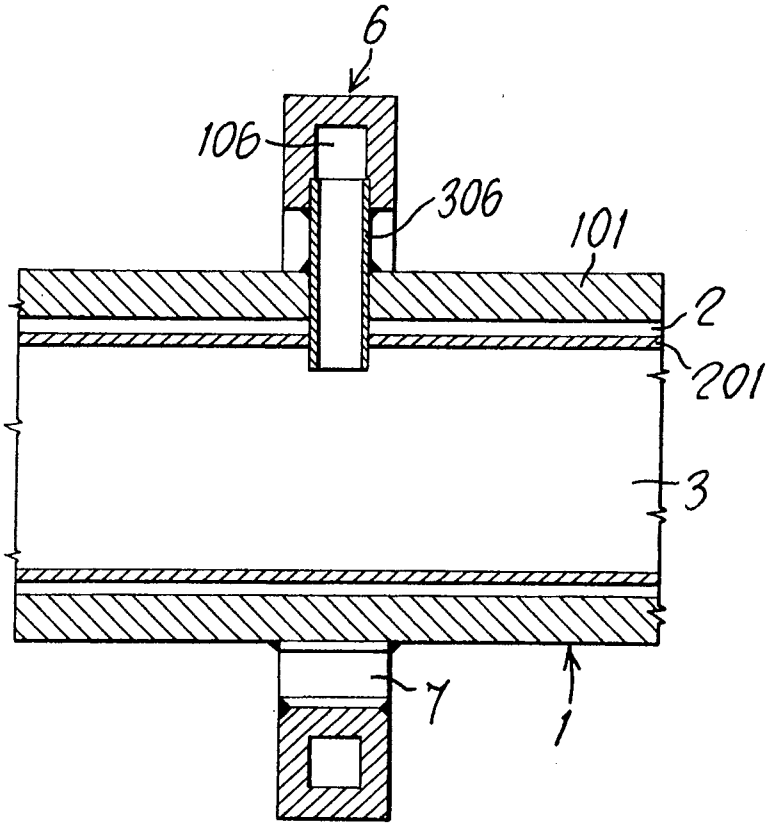
FIG. 4 shows an enlarged axial section through the roller according to FIG. 1, at the location of an annular rider.

With reference to FIGS. 4 and 5 in particular, each annular tubular rider 6 has a toroidal inner chamber 106 of square cross section. The chamber 106 is divided by a radial partition 206. At the location of the partition 206 and on opposite sides of it, the toroidal chamber 106 communicates through an inlet connector 306 with the radially inner supply chamber 3 of the roller 1 and through an outlet connector 406 with the radially outer return chamber 2 of the roller 1. Each annular rider 6 is therefore connected in parallel to the supply and return ducts of the cooling system and has passing through it a flow of fluid orientated transversely with respect to its axis and parallel to its median plane.

As may be clearly seen in FIG. 1, in the terminal areas and in the intermediate areas between the annular riders 6, the roller 1 is coated externally by a layer of refractory material 8 which is uniformly distributed over the peripheral surface of the roller 1 and which has a thickness such that the annular riders 6 project partially beyond it, at least with their radially external sides which support the iron or steel products. The annular riders are made of metallic material or of alloys capable of withstanding the heating temperatures inside the furnace.

Figure 2:
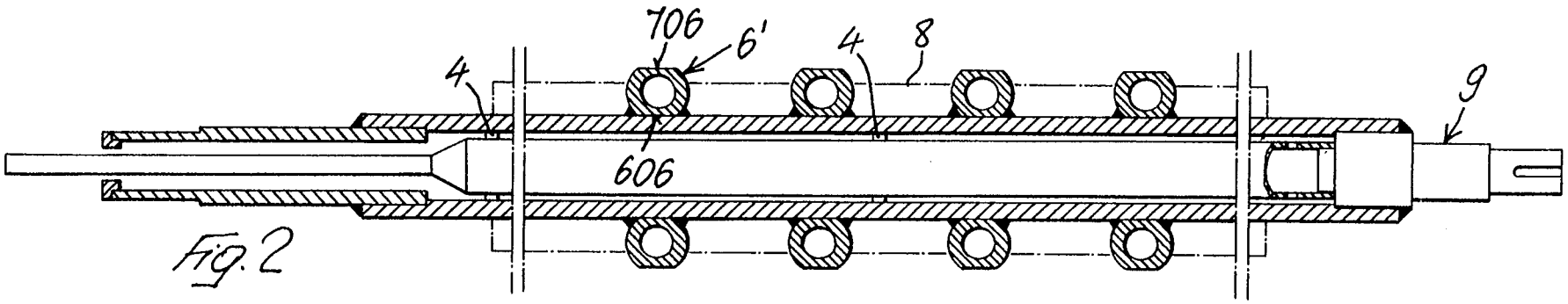
FIG. 2 shows an axial section through a second embodiment of the roller with annular riders according to the invention.
Figure 7:
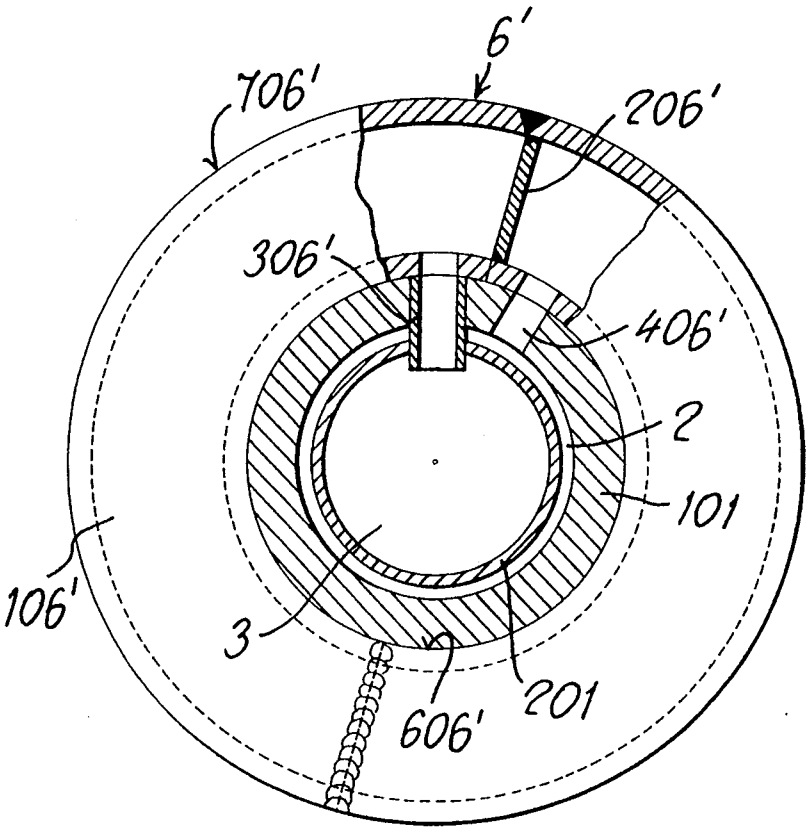
FIG. 7 is a view similar to FIG. 5 of the roller according to FIG. 2.
Figure 6:
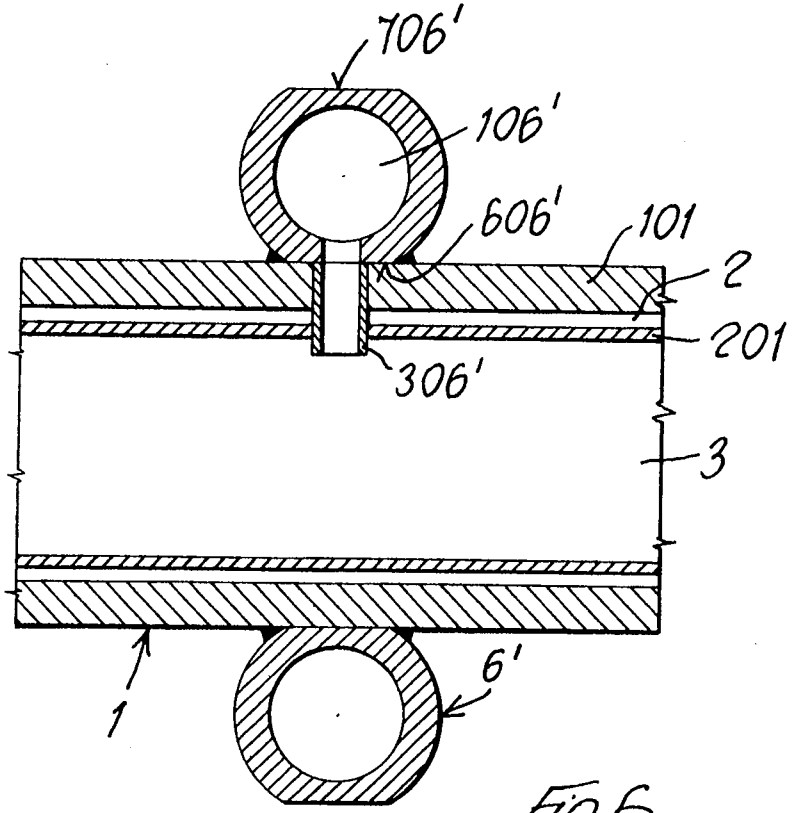
FIG. 6 is a view similar to FIG. 4 of a segment of the roller according to FIG. 2.

FIGS. 2, 6 and 7 illustrate a second embodiment of the invention, the same reference numbers being used to indicate parts identical to those of the preceding embodiment according to FIGS. 1, 4 and 5.

This embodiment differs from the preceding one in respect of the shape of the annular tubular riders which are indicated by 6'.

In this case, the annular tubular riders 6' and the toroidal chamber 106' have a substantially circular cross section; the said toroidal chamber is also divided by a radial partition 206' and is connected on opposite sides of the partition 206' to the supply chamber 3 and to the return chamber 2 respectively of the roller 1 by means of an inlet connector and an outlet connector 306', 406'.

By contrast with the preceding embodiment, the annular tubular riders 6' are fixed with their radially inner sides joined to the outer peripheral surface of the outer tubular element 101 of the roller 1. The annular tubular riders 6' may advantageously be joined to the outer surface of the roller 1 with a flattened area 606' on their radially inner sides. They may be fixed by means of weld beads along the lateral edges of the said flattened area. The outer supporting surface of the annular tubular riders 6' consists of another flattened area 706' on their radially outer sides, opposite the roller 1.

In the same way as in the preceding embodiment, the roller 1 is coated externally with one or more layers of refractory material, shown by a broken line and indicated by 8, this coating 8 having a thickness such that the annular riders 6' project partially beyond it, at least with their supporting flattened areas 706'.

According to a characteristic substantially common to both embodiments, the section of the toroidal chamber 106, 106' for the cooling fluid is relatively large with respect to the overall section, having a radius equal to approximately half the overall external radius. Furthermore, the section of the supply chamber 3 of the roller 1 is relatively large with respect to the flow aperture of the return chamber 2 and to the overall section of the roller and has a radius which is approximately half the overall radius of the roller 1, or that of the outer element 101, while the return chamber 2 consists of a relatively thin space.

In the embodiment shown in FIGS. 1, 4 and 5, the section of the inlet and outlet connectors 306, 406 is substantially of the same order of magnitude as that of the chamber 106.

Figure 3:
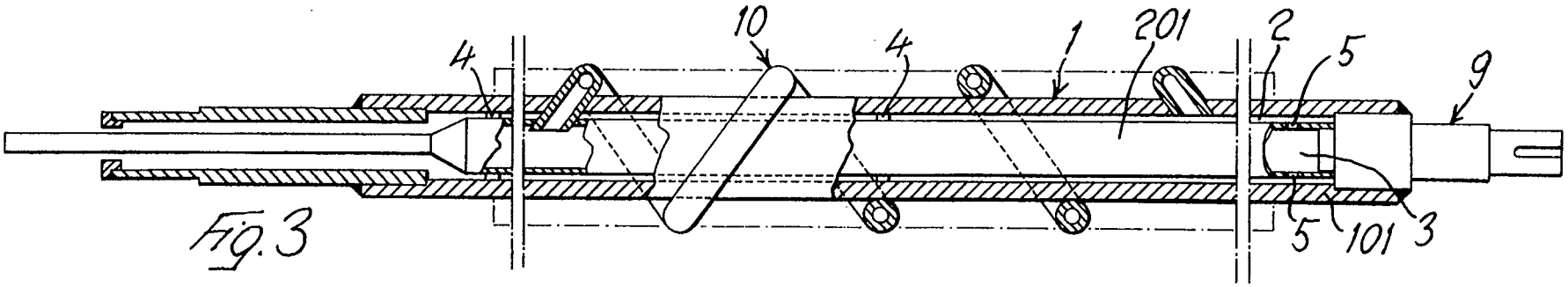
FIG. 3 shows an axial section through a variant embodiment of the roller with helicoidal riders according to the invention.

FIG. 3 shows a variant of the preceding embodiments, in which the annular riders consist of the turns of a tubular helicoid 10 which extends around the roller 1. Instead of a single continuous helicoid it is also possible to provide a number of segments of a helicoid disposed in sequence along the axial extension of the roller 1. The helicoid 10, or each segment of helicoid, is joined to the peripheral outer surface of the roller 1 and is connected at one end to the supply chamber 3 of the roller 1 and at the opposite end to the return chamber 2 of the roller. The flow of the cooling fluid extends coaxially with the extension of the helicoid, transversely with respect to its central axis and parallel to the plane of the individual turns. The tubular helicoid 10 or the segments of helicoid may have any cross section, for example one similar to that of the annular tubular riders 6, 6' of the preceding examples, and may have a flattened supporting area on their radially outer side and/or on their radially inner side.

Figure 8:
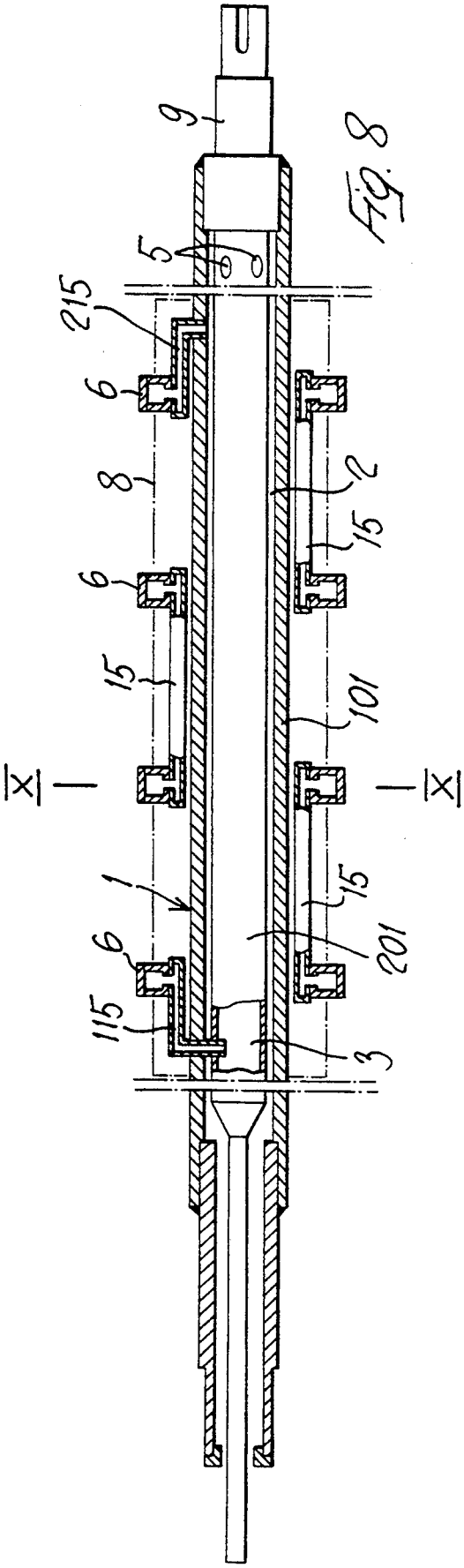
FIG. 8 shows an axial section through a further embodiment of a roller with annular riders according to the invention.
Figure 10:
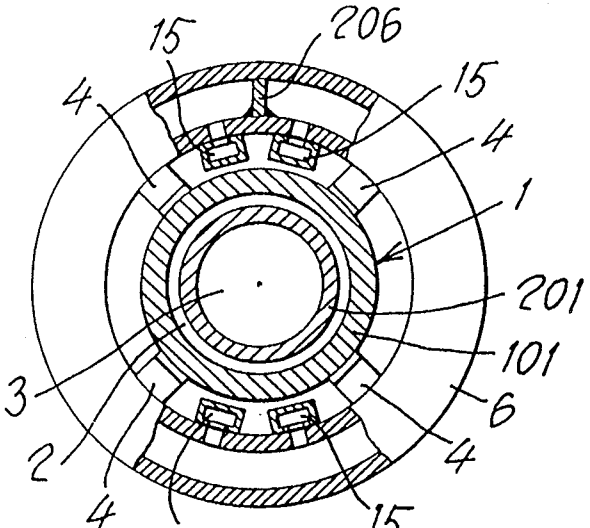
FIG. 10 shows a partial cross section along the line X—X in FIG. 8.
Figure 13:
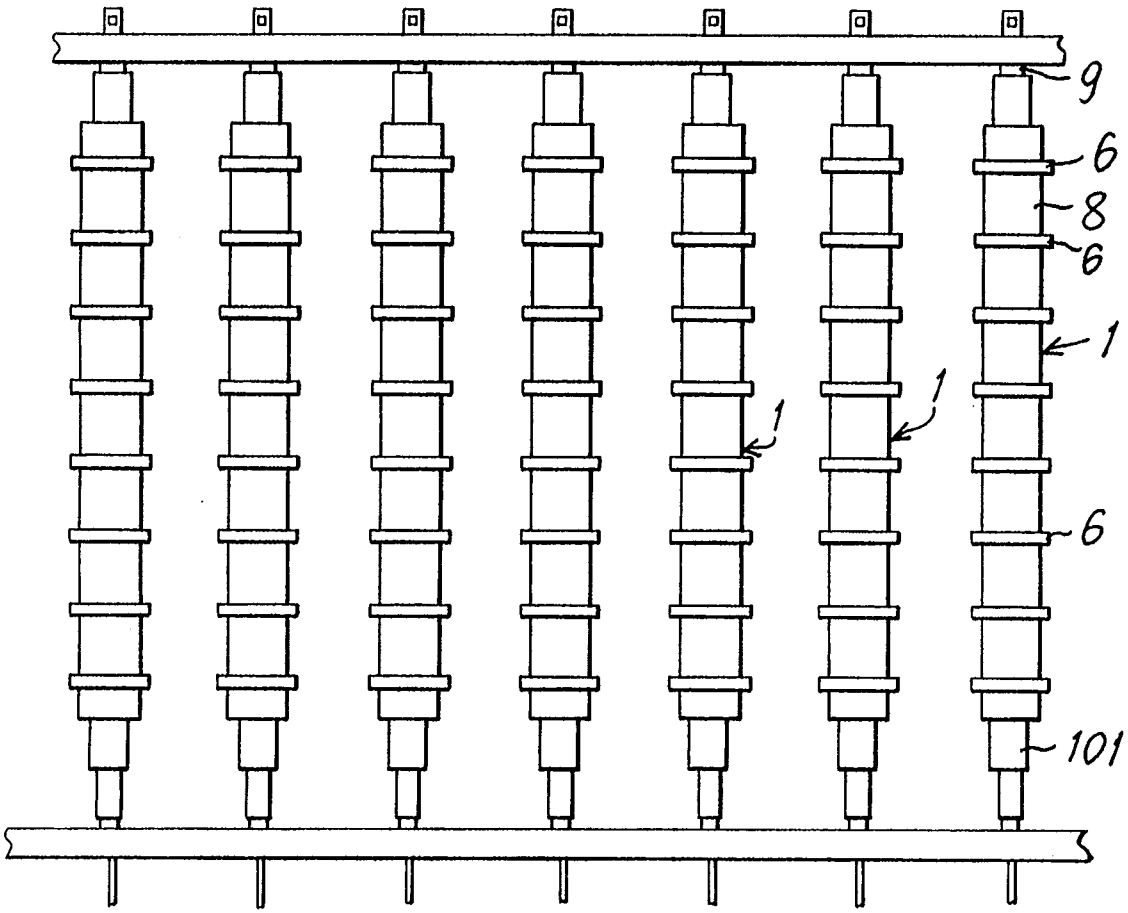
FIG. 13 shows a plurality of rollers according to the invention in a configuration in which they are substantially parallel to each other.

The embodiment illustrated in FIGS. 8 and 10 has annular tubular riders 6 and is made substantially in the same way as the embodiment previously described with reference to FIGS. 1 and 7. Unlike the latter, however, the annular tubular riders 6 in FIGS. 8 and 10, instead of being connected individually to the cooling fluid supply duct 3 and return duct 2, are connected together in series by means of one or more connecting tubes 15 which extend parallel to the roller 1 and outside the roller and are incorporated in the refractory coating 8. The annular rider at one end of this series of riders, for example the left-hand end in FIG. 8, is connected by means of an elbow tube 115 to the cooling fluid supply duct 3, while the annular rider at the other end of the series of riders, on the right in FIG. 8, is connected by means of an elbow tube 215 to the cooling fluid return duct 2. One or more longitudinal connecting tubes 15 may be provided between each two successive annular tubular riders 6. In the embodiment illustrated in FIG. 10, the chamber of each annular tubular rider is divided by means of a radial partition 206, and the successive annular tubular riders 6 communicate with each other alternately by means of two longitudinal connecting tubes 15 provided on opposite sides of the said dividing partition 206 and by means of two connecting tubes 15 provided in a position diametrically opposite the dividing partition 206.

Figure 9:
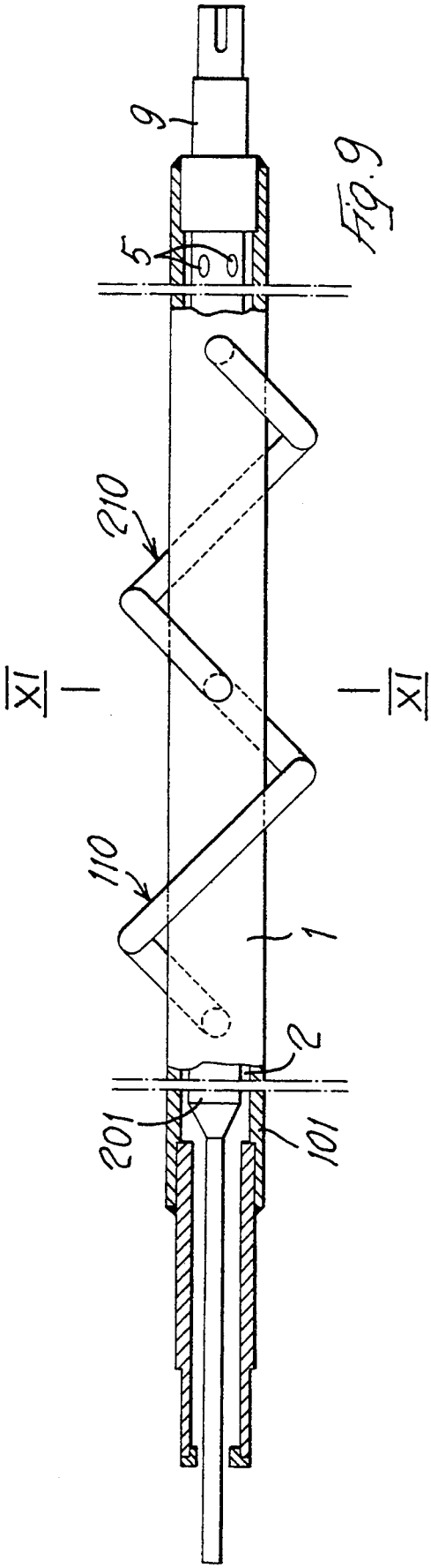
FIG. 9 shows a view, with certain parts in section, of a further embodiment of a roller with helicoidal riders according to the invention.
Figure 12:
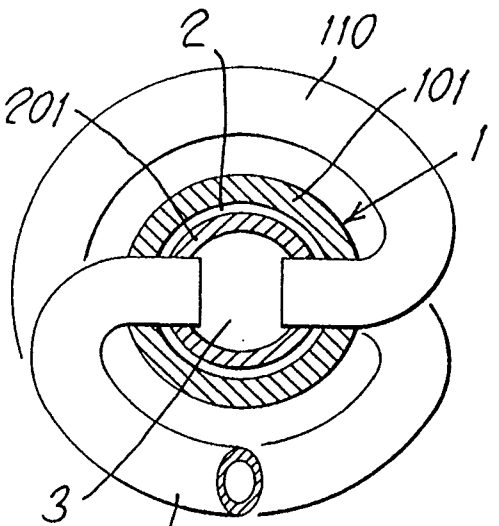
FIGS. 11 and 12 show two different embodiments of the roller with helicoidal riders as shown in FIG. 9, in cross section along the line XI—XI of FIG. 9.
Figure 11:
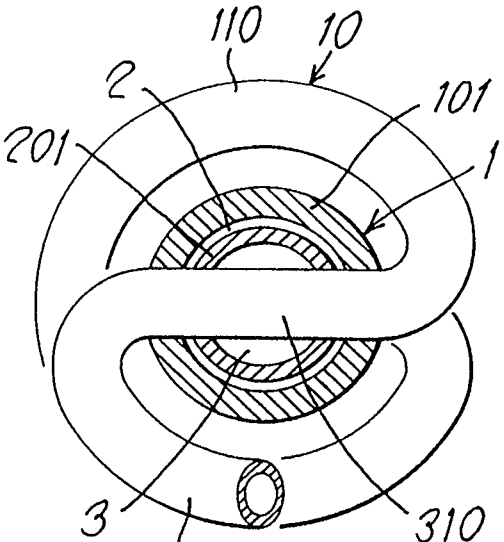

The embodiments illustrated in FIGS. 9, 11 and 12 correspond substantially to the embodiment shown in FIG. 3. In this case, however, the tubular helicoid which extends around the roller 1, and forms the riders with its turns, consists of two successive sections of helicoid 110, 210, one right-handed and the other left-handed, to prevent or at least reduce the movement of the slabs along the roller 1 at the time of their transport transverse to the roller 1. The right-hand section 110 and the left-hand section 210 of the tubular helicoid may be inter-connected by means of a connecting section 310 which passes diametrally with a seal through the roller 1, as illustrated in the variant embodiment shown in FIG. 11. In this case, there is a continuous tubular helicoid with two sections 110 and 210 of opposite inclination, while one end of this helicoid is connected to the supply duct 3 and the other end is connected to the return duct 2 of the cooling fluid.

In the embodiment shown in FIG. 12, however, the two sections of helicoid 110 and 210 with opposite inclination are connected individually to the cooling system. Preferably, for this purpose, the adjacent ends of the two sections of tubular helicoid 110, 210 open on diametrically opposite sides into the inner chamber 3 of the roller 1, which chamber constitutes the cooling fluid supply duct, as illustrated in FIG. 12, while each of them is connected at the opposite end to the space 2 of the roller 1 which space constitutes the cooling fluid return duct. In this case, therefore, the cooling fluid passes through the two sections of helicoid 110, 210 in opposite directions.

In the embodiments shown in FIGS. 9, 11 and 12, each individual continuous helicoid may even have three or more successive sections made in right-hand and left-handed form alternately, while it is also possible to provide three or more individual successive sections of tubular helicoid, connected individually to the cooling system and having alternating opposite inclinations. Finally, it should be noted that in the embodiments as shown in FIGS. 9, 11 and 12 the continuous tubular helicoid 110, 210 and the two sections of tubular helicoid 110 and 210 are spaced radially from the outer surface of the roller 1.

We claim:

1. Roller for furnaces, said roller being part of a plurality of rollers substantially parallel to each other, said roller comprises two coaxial chambers with the first coaxial chamber connected to a supply duct and the second coaxial chamber connected to a return duct for receiving of cooling fluid from a cooling system and a plurality of helicoid tubular collars which are side by side and spaced apart wound around said roller, said tubular collars have inlets and outlets so that said inlets are connected to said first coaxial chamber and said outlets are connected to said second coaxial chamber respectively, and the tubular collars wherein the flow of cooling fluid for the tubular collars being orientated transversely with respect to the longitudinal axis of the roller and parallel to a cross-sectional surface of the tubular collars.

2. Roller according to claim 1, wherein each of said tubular collars comprises an annular form closed on itself to form a toroid and includes an inner chamber having an internal radius equal to at least half of the external radius of the tubular collar.

3. Roller according to claim 2, wherein the inner chamber of each of the tubular collars is toroidal and has a polygonal, square or circular cross section.

4. Roller according to claim 3, wherein the tubular collars have a polygonal, square or circular outer cross section.

5. Roller according to claim 4, said inlets and outlets are connected separately to each of said tubular collars and to a supply duct and to a return duct of said cooling system said inlets and outlets being separated by transverse partitions for dividing each of said inner chambers.

6. Roller according to claim 1, wherein at least two of the tubular collars are connected in series with each other to the cooling system by means of connecting tubes extending substantially parallel to said longitudinal axis of the roller, one of the tubular collars of the series being connected to the supply duct and the other to the return duct of a cooling system.

7. Roller according to claim 6, wherein the connecting tubes extend outside the roller and are incorporated into a refractory coating of the roller.

8. Roller according to claim 5, wherein adjacent tubular collars are connected to each other by means of at least one of connecting tubes located at different angular positions around a circumference of the roller.

9. Roller according to claim 1, wherein the tubular collars comprise turns of at least one tubular helicoid wound around the roller and having one end connected to the supply duct and the other end to the return duct of said cooling system.

10. Roller according to claim 9, wherein the helicoid comprises a plurality of adjacent sections helicoid each of said sections having at least one turn, and connected separately at their ends to the supply duct and to the return duct of the cooling system.

11. Roller according to claim 9, wherein the tubular helicoid comprises at least two adjacent sections made in alternate right-handed and left-handed forms and interconnected by means of tubular connecting systems extending diametrally with a seal through the roller.

12. Roller according to claim 10, wherein the adjacent sections of the helicoid are made in alternating right-handed and left-handed form.

13. Roller according to claim 10, wherein two adjacent sections of the helicoid are connected at their adjacent ends to the supply duct and at their opposite ends to the return duct of the cooling system.

14. Roller according to claim 1, wherein the tubular collars are fixed directly to an outer wall of the roller.

15. Roller according to claim 1, wherein the tubular collars are fixed coaxially to the roller and are spaced from an outer peripheral surface of the roller by means of spacers and compensators which compensate for thermal expansion and contraction, the internal diameter of the collars being greater than the external diameter of the roller.

16. Roller according to claim 1, wherein the tubular collars have a flattened area on an inner side facing an outer peripheral surface of the roller.

17. Roller according to claim 15, wherein the spacers and compensators have an U-shaped transverse section which is transverse with respect to the axis of the roller, and are fixed by the opposite free end sides of their U shape to the outer peripheral surface of the roller and to the tubular collars.

18. Roller according to claim 1, wherein the tubular collars include radially external supporting surfaces comprising flattened areas parallel to and coaxial with an outer surface of the roller.

19. Roller according to claim 1, wherein the tubular collars comprise a metallic material or metallic alloy and the roller is coated externally with a layer of refractory materials having a thickness such that the tubular collars project, at least with their radially external supporting sides, partially beyond the outer peripheral surface of the layer of refractory material.

20. Roller according to claim 1, wherein at one end of the roller, one of the coaxial chambers is connected to the supply duct and the other coaxial chamber is connected to the return duct of the cooling system, while at the opposite end of the roller, the coaxial chambers are closed and communicate with each other.

21. Roller according to claim 1, said two coaxial chambers are tubular cylindrical elements having different diameters, said elements forming a supply chamber in an innermost area of the tubular cylindrical elements, said supply chamber having a relatively large cross-sectional area with respect to the overall cross-sectional area of the roller taken through a plane perpendicular to a longitudinal axis of the roller, and forming a cylindrical return space between the two cylindrical tubular elements, said return space having a relatively thin cross-sectional area with respect to said cross-sectional area of the roller.

22. Roller according to claim 10, wherein two adjacent sections of the helicoid are connected at their adjacent ends to the return duct and at their opposite ends to the supply duct of the cooling system.

* * * * *